US006774552B2

(12) United States Patent
Chiba

(10) Patent No.: US 6,774,552 B2
(45) Date of Patent: Aug. 10, 2004

(54) ELECTRON GUN

(75) Inventor: Akira Chiba, Sagamihara (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 0 days.

(21) Appl. No.: 10/443,817

(22) Filed: May 23, 2003

(65) Prior Publication Data

US 2003/0218413 A1 Nov. 27, 2003

(30) Foreign Application Priority Data

May 27, 2002 (JP) ..... 2002-152592

(51) Int. Cl.[7] ..... H01J 23/06
(52) U.S. Cl. ..... 313/452; 313/448
(58) Field of Search ..... 313/452, 448, 313/449; 315/3.5, 382, 382.1, 368.15

(56) References Cited

U.S. PATENT DOCUMENTS 5,763,893 A * 6/1998 Nakasuji ..... 250/492.2

FOREIGN PATENT DOCUMENTS

| | | | |
|---|---|---|---|
| JP | 58-42142 | A | 3/1983 |
| JP | 63-78428 | A | 4/1988 |
| JP | 3-250528 | A | 11/1991 |
| JP | 8-17078 | B2 | 2/1996 |
| JP | 2590750 | B2 | 12/1996 |

* cited by examiner

*Primary Examiner*—Vip Patel
*Assistant Examiner*—Glenn Zimmerman
(74) *Attorney, Agent, or Firm*—Sughrue Mion, PLLC

(57) ABSTRACT

An electron gun also has a cathode for emitting electrons, a heater cap which contains a heater for applying the cathode with thermal energy for emitting electrons, a retainer for securing the cathode on the heater cap by clamping the peripheral edge of the cathode onto the heater cap, and a cylindrical Wehnelt supporter. The cylindrical Wehnelt supporter has a Wehnelt electrode for focusing an electron beam that is formed in such a shape that an average angle of the surface thereof with respect to an outermost shell of the electron beam matches a Pierce angle, and three or more heater cap supporters for securely supporting the heater cap at a position at which an electron emitting surface of the cathode and an opening formed through the Wehnelt electrode satisfy a predetermined perveance.

10 Claims, 5 Drawing Sheets

ELECTRON GUN

BACKGROUND OF THE INVENTION

1. Field of the Invention

The present invention relates to an electron gun for use with a traveling wave tube, a klystron and the like, and more particularly, to a Pierce type electron gun which has a Wehnelt electrode (also referred to as a "focus electrode") for focusing an electron beam.

2. Description of the Related Art

A traveling wave tube and a klystron are electron tubes which rely on interaction of an electron beam emitted from an electron gun with a high frequency circuit for amplifying and oscillating microwaves. As illustrated in FIG. 1, for example, these electron tubes are each composed of electron gun 21 for emitting an electron beam; high frequency circuit 22 for promoting the interaction of the electron beam emitted from electron gun 21 with a high frequency signal (microwave); a collector 23 for capturing the electron beam delivered from high frequency circuit 22; and anode electrode 24 for guiding the electron beam emitted from electron gun 21 into high frequency circuit 22.

An electron beam emitted from electron gun 21 is introduced into high frequency circuit 22 by anode electrode 24, and travels within high frequency circuit 22 while it interacts with a high frequency signal applied to high frequency circuit 22. The electron beam delivered from high frequency circuit 22 is applied to collector 23 and captured by a collector electrode included in collector 23. In this event, high frequency circuit 22 delivers a high frequency signal which is amplified through the interaction with the electron beam.

While many types of electron guns are known for use with such traveling wave tubes and klystrons, a Pierce type electron gun has a Wehnelt electrode for focusing an electron beam, as one of such electron guns.

FIG. 2 is a lateral sectional view illustrating the structure of a conventional Pierce type electron gun.

As illustrated in FIG. 2, the conventional Pierce type electron gun comprises cathode 11 for emitting electrons; and a Wehnelt electrode 15 for focusing electrons emitted from cathode 11.

Cathode 11 is made of a discal porous tungsten base impregnated with an oxide (emitter material) of barium (Ba), calcium (Ca), aluminum (Al) or the like, and is bonded to cylindrical heater cap 12 made of molybdenum (Mo) or the like by welding or brazing to seal an open end thereof. Cathode 11 should be formed thick enough to endure the welding or brazing temperature and facilitate the bonding of cathode 11 to the cylindrical inner wall of heat cap 12 at a right angle. A heater, not shown, is disposed within heater cap 12 for applying thermal energy for emitting electrons from cathode 11.

Wehnelt electrode 15 is formed in a troidal shape having an opening at the center by cutting a metal material such as molybdenum, and bonded to one open end of Wehnelt support 14 formed in a cylindrical shape by welding or brazing.

Heater cap 12 mounted with cathode 11 is supported in Wehnelt supporter 14, for example, in a tripod structure, by metal supporters 16 made of tantalum (Ta), molybdenum (Mo), molybdenum-rhenium (Mo—Re) alloy, iron-nickel-cobalt alloy (koval:Kv), or the like, and fixed at a position at which an electron emitting surface of cathode 11 is substantially coplanar with the surface of Wehnelt electrode 15. As illustrated in FIG. 2, Wehnelt electrode 15 is formed such that its surface closer to anode electrode 19 has an angle of approximately 67.5 degrees to the outermost shell of electron beam 18 (referred to as the "Pierce angle").

Wehnelt supporter 14, which contains heat cap 12 mounted with cathode 11, is securely fixed within an electron gun housing for vacuum encapsulation.

In the foregoing Pierce type electron gun, Wehnelt electrode 15 is applied with the same potential as cathode 11 to make a focusing action which shapes electrons emitted from cathode 11 into a beam which is introduced into the high frequency circuit (see FIG. 1) by anode electrode 19.

In the conventional Pierce type electron gun, an electrode spacing between the cathode and Wehnelt electrode, and an electrode spacing between the cathode and anode electrode, i.e., perveance must be made consistent with design values with high accuracy in order to focus electrons emitted from the cathode within a desired beam diameter. Particularly, it is critical to satisfy a dimensional accuracy for a narrow spacing between the cathode and Wehnelt electrode.

A large perveance between the cathode and Wehnelt electrode would give rise to collision of electrons emitted from the cathode with the anode electrode, and a varying diameter of an electron beam within the high frequency circuit to cause uneven interaction with a high frequency signal, resulting in increased power consumption, degraded amplification performance, and the like of the traveling wave tube.

In the structure of the conventional Pierce type electron gun illustrated in FIG. 2, it is quite difficult to integrally form the Wehnelt electrode, Wehnelt supporter and metal supporters through cutting operations, so that the Wehnelt electrode, heater cap, metal supporters and Wehnelt supporter are separately formed and bonded to one another by welding, brazing or the like. Thus, the conventional Pierce type electron gun has disadvantages of a larger number of parts and a long time required for assembling. In addition, since a larger number of parts causes an increase in dimensional errors of respective parts, mounting errors and distortion associated with bonding, and the like, it is difficult to limit the perveance of the cathode and Wehnelt electrode within a predetermined value.

SUMMARY OF THE INVENTION

It is therefore an object of the present invention to provide a Pierce type electron gun which prevents an increase in power consumption of a heater and an increase in perveance, and is composed of a fewer number of parts to facilitate its assembly.

To achieve the above object, an electron gun according to the present invention has a cathode for emitting electrons, a heater cap which contains a heater for applying the cathode with thermal energy for emitting electrons, a retainer for securing the cathode on the heater cap by holding the peripheral edge of the cathode to the heater cap, and a cylindrical Wehnelt supporter that has a Wehnelt electrode for focusing an electron beam formed in such a shape that an average angle of the surface thereof with respect to an outermost shell of said electron beam matches a Pierce angle, and three or more heater cap supporters for securely supporting said heater cap at a position at which an electron emitting surface of said cathode and an opening formed through said Wehnelt electrode satisfy a predetermined perveance.

Thus, the number of parts is reduced by integrally forming the Wehnelt supporter, Wehnelt electrode and heater cap supporters, resulting in a reduction in dimensional error of each part, mounting errors and distortion associated with bonding, and the like. Consequently, the perveance of the cathode and Wehnelt electrode is readily limited within a predetermined value. In addition, since the Wehnelt supporter including the Wehnelt electrode and heater cap supporters can be formed through pressing, less time is required for machining respective parts and assembling these parts into the Wehnelt supporter, and the cost is also reduced for the electron gun.

Also, in the present invention, each of the heater cap supporters is formed by cutting out the cylindrical side surface of the Wehnelt supporter in a strip shape except for one short side. In this event, the short side, left uncut, is one of sides parallel with the circumferential direction of the Wehnelt supporter, which is closer to the Wehnelt electrode. By thus forming the heater cap supporters in a strip shape except for the side closer to the Wehnelt electrode, heat radiated from the heater cap is prevented from leaking from strip-shaped openings formed through the side surface of the Wehnelt supporter, thereby saving the power consumption of the heater.

Further, in the present invention, the retainer has one end, which is brought into engagement with the cathode, in a folded shape or an arcuate shape. Since the thus shaped retainer is less susceptible to deformation due to the inflated cathode by the heat from the heater, the retainer maintains a sufficient force for retaining the cathode to prevent the cathode from shifting.

The above and other objects, features, and advantages of the present invention will become apparent from the following description with reference to the accompanying drawings, which illustrate examples of the present invention.

DETAILED DESCRIPTION OF THE PREFERRED EMBODIMENT

Figure 3:
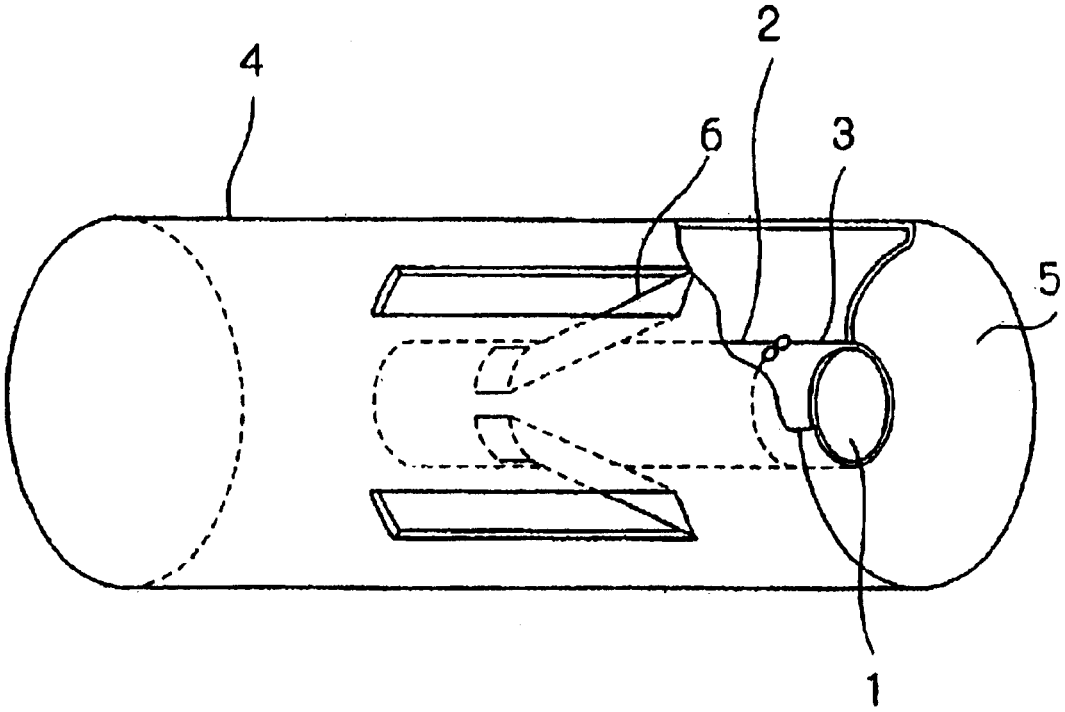
FIG. 3 is a perspective view illustrating the configuration of an exemplary electron gun according to the present invention.
Figure 4A:
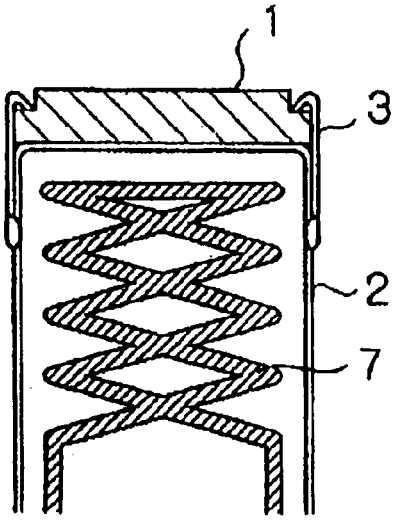
FIGS. 4A and 4B are cross-sectional views each illustrating a main portion of an exemplary structure for mounting a cathode shown in FIG. 3.
Figure 4B:
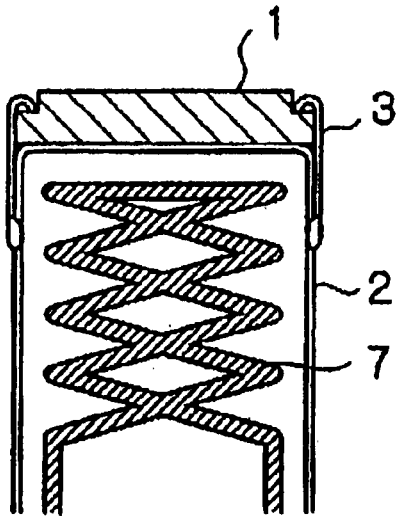
Figure 6:
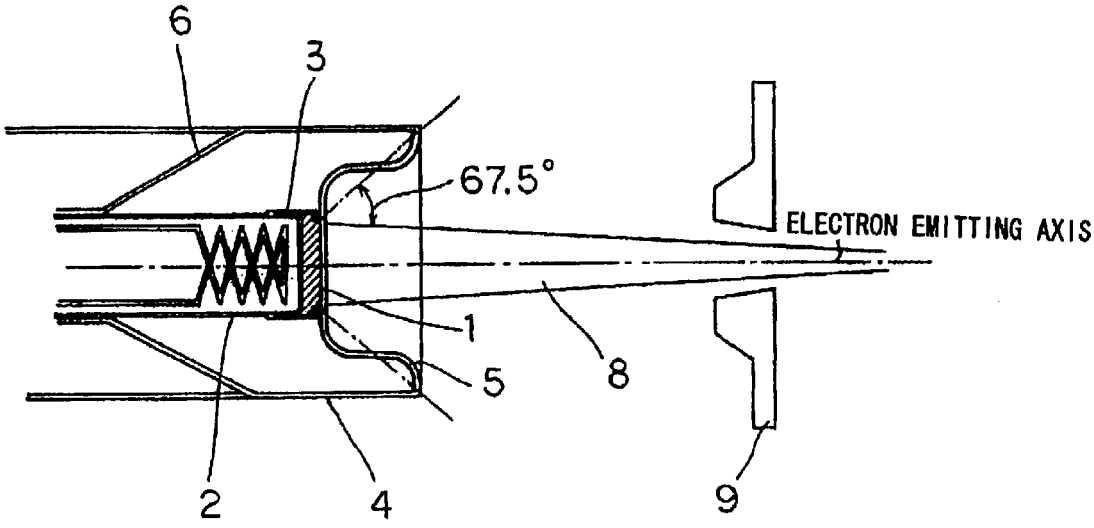
FIG. 6 is a schematic diagram illustrating the relationship among the Wehnelt electrode, electron beam and anode electrode shown in FIG. 3.
Figure 7:
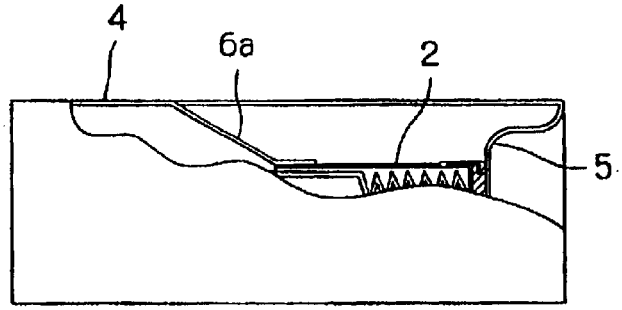
FIG. 7 is a lateral view illustrating another exemplary configuration of the heater cap supporter shown in FIG. 3.

FIG. 3 is a perspective view illustrating the configuration of an exemplary electron gun according to the present invention. FIGS. 4A and 4B are cross-sectional views each illustrating a main portion of a structure for mounting a cathode shown in FIG. 3. FIGS. 5A to 5E are lateral views each illustrating an exemplary shape of the Wehnelt electrode shown in FIG. 3. FIG. 6 is a schematic diagram illustrating the relationship among the Wehnelt electrode, electron beam and anode electrode shown in FIG. 3. FIG. 7 is a lateral view illustrating another exemplary configuration of the heater cap supporter shown in FIG. 3. It should be noted that Wehnelt supporter 4 and Wehnelt electrode 5 illustrated in FIGS. 3, 5A–5E, and 7 are partially cut away in order to show how heater cap 2 is supported in Wehnelt supporter 4. As will be appreciated, actual Wehnelt supporter 4 and Wehnelt electrode 5 are not cut out as shown in FIGS. 3, 5A–5E and 7, except for portions of Wehnelt supporter 4 used to form heater cap supporter 6.

As illustrated in FIG. 3, the electron gun according to the present invention comprises cathode 1 for emitting electrons; heater cap 2 which contains heater 7 (see FIG. 4) for applying cathode 1 with thermal energy for emitting electrons from cathode 1; retainer 3 for securing cathode 1 on heater cap 2 by clamping the peripheral edge of cathode 1 onto heater cap 2; and Wehnelt supporter 4 for supporting heater cap 2.

Wehnelt supporter 4 is formed by machining a thin metal plate made of tantalum, molybdenum, molybdenum-rhenium alloy (Mo—Re) or the like thermally treated under vacuum into a cylindrical shape, as illustrated in FIG. 3. Wehnelt electrode 5 is formed by bending a side surface toward the interior of the cylinder to close one open end thereof. A circular opening is formed at the center of Wehnelt electrode 5 for exposing an electron emitting surface of cathode 1. Wehnelt supporter 4 is formed on its side surface with three or more heater cap supporters 6, each of which is cut out in a strip shape except for one shorter side.

Heater cap 2 is in the shape of a closed cylinder which has a flat closed surface perpendicular to the side wall of cylindrical heater cap 2.

Heater cap 2 mounted with cathode 1 is suspended within Wehnelt supporter 4 by bonding end portions of respective heater cap supporters 6, including the other shorter sides, to heater cap 2 by welding, brazing or the like, such that the electron emitting surface of cathode 1 and the opening formed through Wehnelt electrode 5 are fixed at positions at which a predetermined perveance is satisfied.

As illustrated in FIGS. 4A and 4B, cathode 1 comprises a discal porous tungsten base impregnated with an emitter material made of an oxide of barium, calcium, aluminum or the like, as before. The electron emitting surface is formed by a portion of a flat or a concave spherical surface, while the surface opposite to the electron emitting surface is made flat. Cathode 1 is also formed with a cut-away step along the peripheral edge such that retainer 3 is hung on the step to press cathode 1 onto the closed surface of heater cap 2. The step formed along the peripheral edge of cathode 1 has such a depth that a folded or arcuate end of retainer 3, later described, does not protrude from the electron emitting surface of cathode 1.

Retainer 3, which is made of molybdenum or the like, is formed in a cylindrical shape, and has one end, which is later brought into engagement with cathode 1, machined into a folded shape as can be seen in FIG. 4A or into an arcuate shape as can be seen in FIG. 4B. The other end of retainer 3, opposite to cathode 1, is bonded to heater cap 2 by welding or brazing after retainer 3 is held on cathode 1. Cathode 1 is pressed by the folded end shown in FIG. 4A or by the arcuate end shown in FIG. 4B onto the closed surface of heater cap 2 and fixed thereon.

Figure 2:
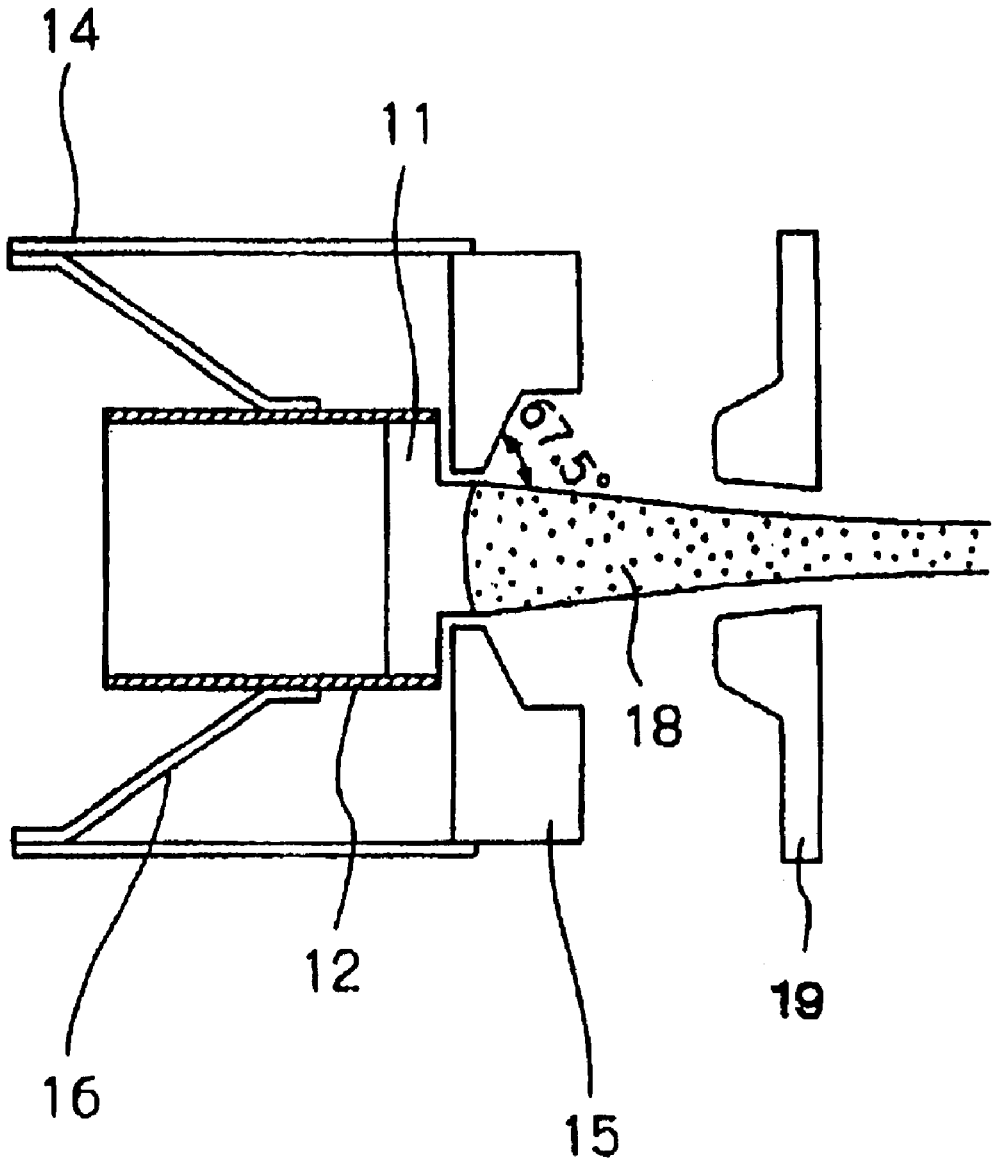
FIG. 2 (PRIOR ART)
FIG. 2 is a lateral sectional view illustrating the structure of a conventional Pierce type electron gun.

Cathode 1 illustrated in FIGS. 4A and 4B has the flat electron emitting surface and surface opposite thereto, by way of example. Alternatively, cathode 1 may have an electron emitting surface formed by a portion of a concave spherical surface, and a flat surface opposite to the electron emitting surface, for example, as illustrated in FIG. 2. In the present invention, any cathode 1 may be used as long as the step formed along the peripheral edge of cathode 1 has a width large enough to accommodate the end of retainer 3, as illustrated in FIGS. 4A and 4B.

When retainer 3 is used to fix cathode 1 on the closed surface of heater cap 2 in the manner described above, cathode 1 will not be applied with heat caused by brazing or welding, as has been experienced before. In addition, heater cap 2 need not be mounted in heater cap 2 at a right angle to the side wall of cylindrical heater cap 2, so that cathode 1 can be made thinner than before. Consequently, a reduction in the weight of cathode 1 helps improve the endurance of the electron gun to vibrations and impacts applied thereto.

Also, since the end of retainer 3 in engagement with cathode 1 is folded back or formed in an arcuate shape as illustrated in FIGS. 4A and 4B, retainer 3 is prevented from deformation which could be caused by cathode 1 inflated by heat from heater 7, thereby permitting retainer 3 to maintain the force for retaining cathode 1 to prevent cathode 1 from shifting in position.

Heater 7 is disposed within heater cap 2 for applying thermal energy for emitting electrons from cathode 1 in a manner similar to the prior art.

Figure 5A:
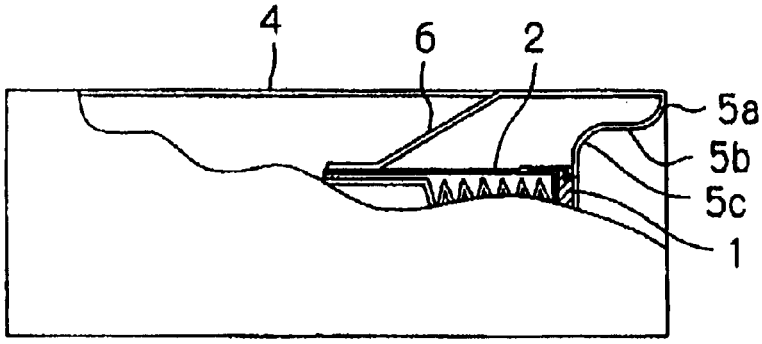
FIGS. 5A to 5E are lateral views each illustrating an exemplary shape of the Wehnelt electrode shown in FIG. 3.
Figure 5B:
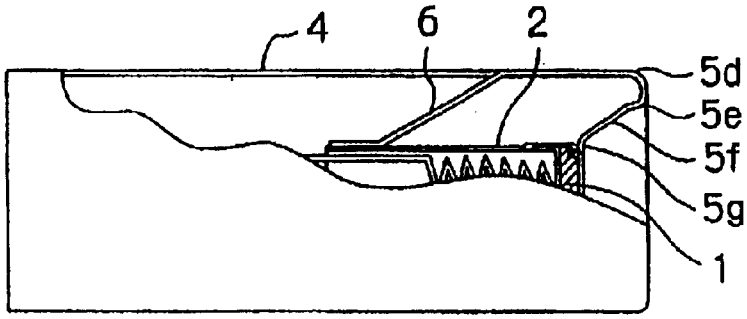
Figure 5C:
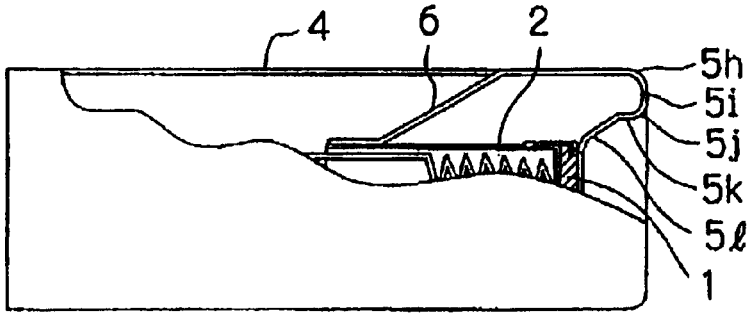
Figure 5D:
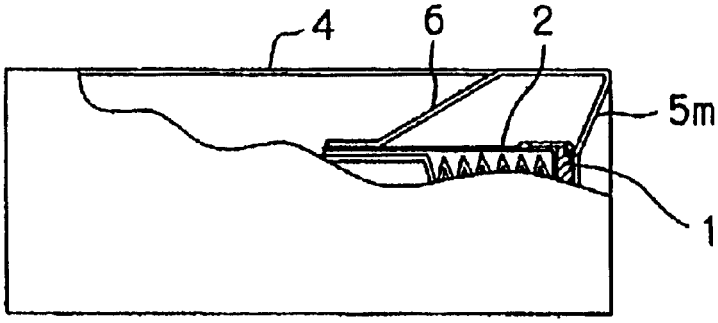
Figure 5E:
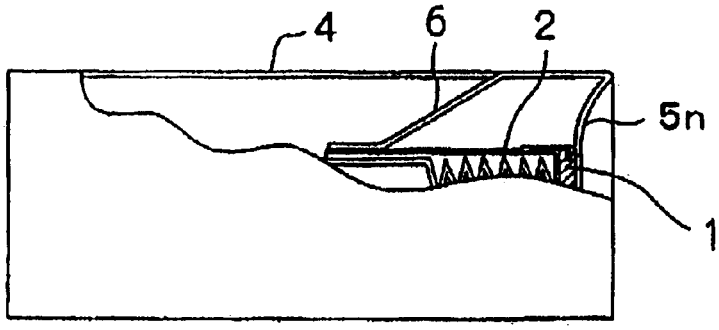

Wehnelt electrode 5 may be formed in any of shapes as viewed in cross section illustrated in FIGS. 5A to 5E. FIG. 5A illustrates exemplary Wehnelt electrode 5 which is comprised of first arcuate section 5*a*, linear section 5*a*, and second arcuate section 5*c* formed in order from the cylindrical side surface of Wehnelt supporter 4 to the opening, as viewed in cross section; FIG. 5B illustrates exemplary Wehnelt electrode 5 which is comprised of first arcuate section 5*d*, second arcuate section 5*e*, first linear section 5*f*, and second linear section 5*g*, as viewed in cross section; and FIG. 5C illustrates exemplary Wehnelt electrode 5 which is comprised of first arcuate section 5*h*, first linear section 5*i*, second arcuate section 5*j*, second linear section 5*k*, and third linear section 51, as viewed in cross section. FIG. 5D illustrates exemplary Wehnelt electrode 5 which is comprised of linear section 5*m* extending from the cylindrical side surface of Wehnelt supporter 4 to the opening, as viewed in cross section, and FIG. 5E illustrates exemplary Wehnelt electrode 5 which is comprised of arcuate section 5*n*, as viewed in cross section.

Figure 1:
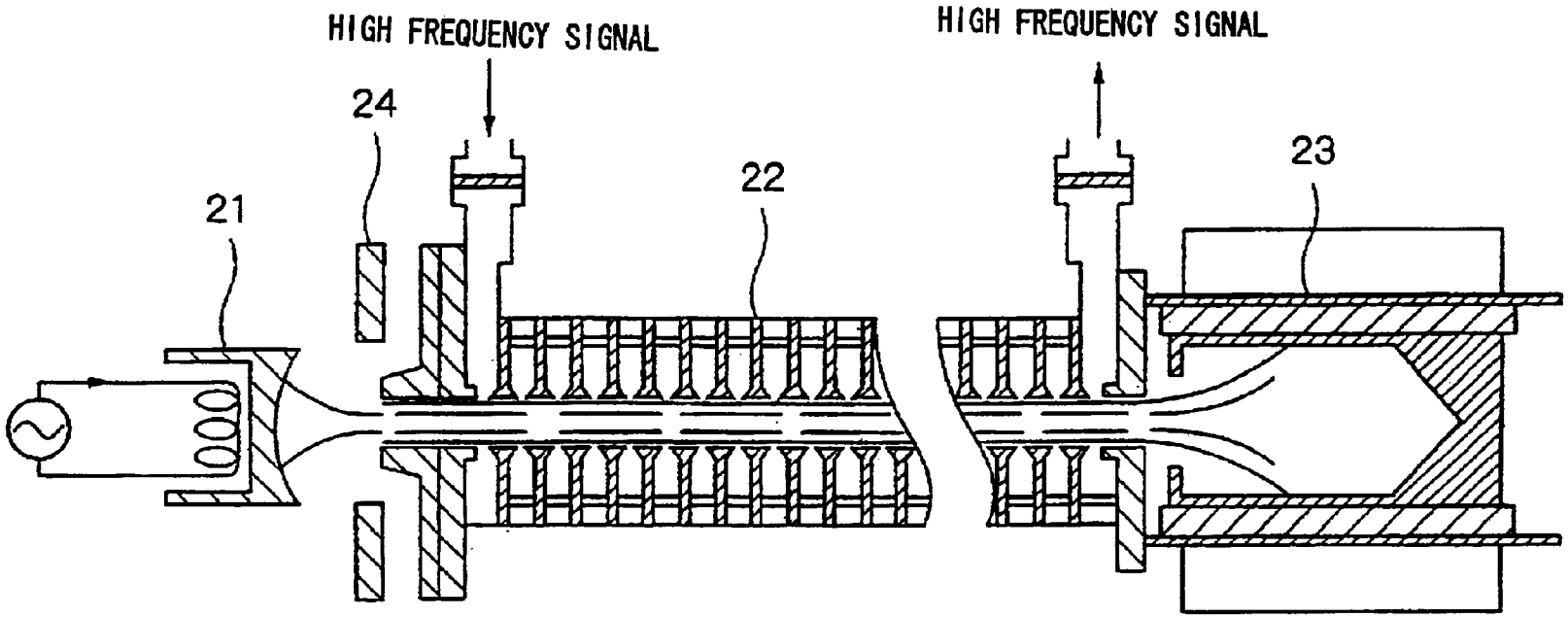
FIG. 1 (PRIOR ART)
FIG. 1 is a lateral sectional view illustrating the configuration of an exemplary traveling wave tube.

Since all of the shapes illustrated in FIGS. 5A to 5E can be realized by pressing, the present invention eliminates the need for bonding separately prepared Wehnelt electrode and Wehnelt supporter by welding, brazing or the like, as is the case with the conventional electron gun illustrated in FIG. 1, resulting in a reduction in the time required for machining and assembly as well as the cost of the electron gun.

Further, in Wehnelt electrode 5 having a combination of arcuate sections and a linear section (sections) as illustrated in FIGS. 5A to 5C, electrons can be focused more at a location away from cathode 1 (closer to anode electrode 9) by the action of the arcuate section and linear section formed close to the side surface of Wehnelt supporter 4, so that Wehnelt electrode 5 can be reduced in size, as compared with Wehnelt electrode 5 illustrated in FIG. 5D which is comprised only of a linear section or Wehnelt electrode 5 illustrated in FIG. 5E which is comprised only of an arcuate section.

Also, in the present invention, any of Wehnelt electrodes 5 illustrated in FIGS. 5A to 5E has an average angle of the surface closer to anode electrode 9 which is substantially equal to a Pierce angle (67.5 degrees) with respect to the outermost shell of an electron beam. The average angle used herein refers to the average of angles of those sections which contribute to the focusing of electrons. For example, in Wehnelt electrode 5 having the shape illustrated in FIG. 5A, the average angle refers to the average of angles formed by the surfaces of first arcuate section 5*a*, linear section 5*b*, and second arcuate section 5*c* with respect to the outermost shell of the electron beam. The average angle substantially matches the angle of a straight line which connects the starting point of first arcuate section 5*a*, extending from the cylindrical side surface of Wehnelt supporter 4 to the opening, with the end point of second arcuate section 5*c*.

In Wehnelt electrode 5 having the shape illustrated in FIG. 5B, the average angle is the average of angles formed by the surfaces of second arcuate section 5*e*, first linear section 5*f*, and second linear section 5*g* with respect to the outermost shell of the electron beam, and the average angle substantially matches the angle of a straight line which connects the starting point of second arcuate section 5*e*, extending from the cylindrical side surface of Wehnelt supporter 4 to the opening, with the end point of second linear section 5*g*.

Similarly, in Wehnelt electrode 5 having the shape illustrated in FIG. 5C, the average angle is the average of the angles formed by the surfaces of second arcuate section 5*j*, second linear section 5*k*, and third linear section 51 with respect to the outermost shell of the electron beam, and the average angle substantially matches the angle of a straight line which connects the starting point of second linear section 5*k*, extending from the cylindrical side surface of Wehnelt supporter 4 to the opening, with the end point of third linear section 51.

Also, in Wehnelt electrode 5 having the shape illustrated in FIG. 5E, the average angle substantially matches the angle of a straight line which connects the starting point with the end point of arcuate section 5*m*.

FIG. 6 illustrates an exemplary relationship among Wehnelt electrode 5, electron beam 8 and anode electrode 9 according to the present invention. Specifically, in the relationship illustrated in FIG. 6, Wehnelt electrode 5 employs the shape illustrated in FIG. 5A.

For maintaining a Pierce angle formed by Wehnelt electrode 5 and the outermost shell of electron beam 8, the average angle of the surface of Wehnelt electrode 5 to the axis along which electrons are emitted (electron emitting axis) varies depending on the relationship with anode electrode 9. Specifically, the average angle of the surface of Wehnelt electrode 5 with respect to the electron emitting axis varies depending on the distance from anode electrode 9 and the inner diameter of anode electrode 9 (a diameter in which an electron beam is focused). In the exemplary electron guns illustrated in FIGS. 5A to 5E, Wehnelt electrodes 5 have different average angles of their surfaces to the electron emitting axis from one another because these figures are not drawn on the assumption that these electron guns have the same distance between Wehnelt electrode 5 and anode electrode 9 and the same inner diameter of anode electrode 9.

The present invention realizes an electron focusing action in addition to the ease of formation of Wehnelt electrode 5 through pressing by forming Wehnelt electrode 5 in a shape comprised of arcuate section and linear section in combination, in a shape comprised only of a linear section, or in a shape comprised only of an arcuate section, as illustrated in FIGS. 5A to 5E.

The inventors have confirmed through a simulation that electrons emitted from cathode 1 are focused without problem when the average angle of the surface of Wehnelt electrode 5 with respect to the outermost shell of electron beam 8 substantially matches the Pierce angle as in the present invention.

It should be understood that Wehnelt electrode 5 of the present invention is not limited in shape to those illustrated in FIGS. 5A to 5E, but may be in any shape as long as the average angle of the surface of Wehnelt electrode 5 substantially matches the Pierce angle, as mentioned above.

While each of FIGS. 3 and 5A to 5E illustrates the structure in which heater cap 2 is supported by heater cap supporters 6, each of which is cut out in a strip shape except for the short side closer to Wehnelt electrode 5 out of the sides parallel with the circumferential direction of Wehnelt supporter 4, heater cap 2 may be supported by heater cap supporters 6*a*, each of which is cut in a strip shape except for the short side opposite to Wehnelt electrode 5, as illustrated in FIG. 7.

In the structure illustrated in FIG. 7, since heater cap supporters 6*a* are at locations away from the side surface of heater cap 2, heater cap supporters 6*a* are applied with less heat radiated from heater cap 2 and therefore are prevented from being heated, as compared with those in the structures illustrated in FIGS. 3 and 5A to 5E. Consequently, a required supporting strength can be ensured by heater cap supporters 6*a*, even if they are reduced in width, because heater cap supporters 6*a* are prevented from a reduction in flexural strength due to the heat.

However, in the structure illustrated in FIG. 7, the heat irradiated from heater 2 leaks more from strip-shaped openings formed through the side surface of Wehnelt supporter 4, as compared with the structure illustrated in FIGS. 3 and 5A to 5E, resulting in larger heat dissipation from heater cap 2 and a consequent increase in power consumption of heater 7. From this point of view, heater cap 2 is preferably supported by heater cap supporters 6, each of which is cut in strip shape except for the short side closer to Wehnelt electrode 5, as illustrated in FIGS. 3 and 5A to 5E.

As described above, since the electron gun according to the present invention has Wehnelt electrode 5 and heater cap supporters 6 formed integrally in Wehnelt supporter 4 to reduce the number of parts as compared with the prior art structure, the perveance of cathode 1 and Wehnelt electrode 5 can be readily limited within a predetermined value. In addition, since Wehnelt supporter 4 including Wehnelt electrode 5 and heater cap supporters 6 can be readily formed through pressing, less time is required for machining respective parts and assembling these parts into Wehnelt supporter 4, and the cost is also reduced for the electron gun.

The electron gun of the present invention illustrated in FIG. 3 has Wehnelt electrode 5 and heater cap supporters 6 integrally formed with Wehnelt supporter 4, and the heat of cathode 1 heated by heater 7 is conducted to adjoining Wehnelt electrode 5 through radiation. Structurally, the heat of cathode 1 is relatively likely to dissipate. However, since Wehnelt supporter 4 (Wehnelt electrode 5) is formed of a thin metal plate (for example, having a thickness of approximately 0.03 mm) in the present invention, Wehnelt electrode 5 has a lower thermal conductivity to prevent the heat from dissipating from cathode 1 to save more power consumption of heater 7 than the conventional structure illustrated in FIG. 2.

Generally, the emitter material evaporates from the cathode which is heated in operation and sticks to the Wehnelt electrode. Therefore, in the structure which allows the heat of the cathode to readily conduct to the Wehnelt electrode, electrons are also emitted from the Wehnelt electrode, which has been heated like the cathode, and repel those electrons emitted from the cathode, thereby making it difficult to fit an electron beam onto a predetermined trajectory. In the present invention, since Wehnelt electrode 5 is formed of a thin metal plate, the temperature of Wehnelt electrode 5 can be limited to not higher than 500° C. even if cathode 1 reaches temperatures in a range of approximately 1,000 to 1,050° C. in operation, thus preventing electrons from being emitted from Wehnelt electrode 5.

While preferred embodiments of the present invention have been described using specific terms, such description is for illustrative purposes only, and it is to be understood that changes and variations may be made without departing from the spirit or scope of the following claims.

What is claimed is:

1. An electron gun comprising:

a cathode for emitting electrons;

a heater cap which contains a heater for applying said cathode with thermal energy for emitting electrons;

a retainer for securing said cathode on said heater cap by clamping the peripheral edge of said cathode onto said heater cap; and a cylindrical Wehnelt supporter that has a Wehnelt electrode for focusing an electron beam formed in such a shape that an average angle of the surface thereof with respect to an outermost shell of said electron beam matches a Pierce angle, and three or more heater cap supporters for securely supporting said heater cap at a position at which an electron emitting surface of said cathode and an opening formed through said Wehnelt electrode satisfy a predetermined perveance.

2. The electron gun according to claim 1, wherein:

said heater cap supporters are each formed by cutting the cylindrical side surface of said Wehnelt supporter in a strip shape except for one short side.

3. The electron gun according to claim 2, wherein:

said one short side is a side closer to said Wehnelt electrode out of sides parallel with the circumferential direction of said Wehnelt supporter.

4. The electron gun according to claim 1, wherein:

said retainer is formed to have a folded end, said folded end being brought into engagement with said cathode to press the peripheral edge of said cathode onto said heater cap.

5. The electron gun according to claim 1, wherein:

said retainer is formed to have an arcuate end, said arcuate end being brought into engagement with said cathode to press the peripheral edge of said cathode onto said heater cap.

6. The electron gun according to claim 1, wherein:

said Wehnelt electrode is comprised of a first arcuate section, a linear section, and a second arcuate section formed in order from the cylindrical side surface of said Wehnelt supporter to said opening.

7. The electron gun according to claim 1, wherein:

said Wehnelt electrode is comprised of a first arcuate section, a second arcuate section, a first linear section, and a second linear section formed in order from the side surface of said Wehnelt supporter to said opening.

8. The electron gun according to claim 1, wherein:

said Wehnelt electrode is comprised of a first arcuate section, a first linear section, a second arcuate section, a second linear section, and a third linear section formed in order from the side surface of said Wehnelt supporter to said opening.

9. The electron gun according to claim 1, wherein:

said Wehnelt electrode is comprised of a linear section extending from the side surface of said Wehnelt supporter to said opening.

10. The electron gun according to claim 1, wherein:

said Wehnelt electrode is comprised of an arcuate section extending from the side surface of said Wehnelt supporter to said opening.

* * * * *